United States Patent [19]

McLeod

[11] Patent Number: 4,993,489

[45] Date of Patent: Feb. 19, 1991

[54] WELLHEAD ISOLATION TOOL

[76] Inventor: Roderick D. McLeod, 5104-125 St., Edmonton, Alberta, Canada, T6H 3V5

[21] Appl. No.: 426,235

[22] Filed: Oct. 25, 1989

[30] Foreign Application Priority Data

Oct. 28, 1988 [CA] Canada ..... 581611

[51] Int. Cl.[5] ..... E21B 23/06; E21B 33/02

[52] U.S. Cl. ..... 166/72; 166/96; 166/196; 166/387

[58] Field of Search ..... 166/72, 73, 77, 80, 166/96, 97, 82, 85, 196

[56] References Cited

U.S. PATENT DOCUMENTS 1,811,422 6/1931 Brown ..... 166/80
2,010,992 8/1935 Howard ..... 166/80
2,721,614 10/1955 Simmons ..... 166/77 X
4,479,537 10/1984 Reed ..... 166/77
4,657,075 4/1987 McLeod ..... 166/72
4,691,770 9/1987 McLeod ..... 166/73

FOREIGN PATENT DOCUMENTS 1217128 1/1987 Canada .

*Primary Examiner*—Stephen J. Novosad
*Attorney, Agent, or Firm*—Stevens, Davis, Miller & Mosher

[57] ABSTRACT

A wellhead isolation tool is presented which includes an expanding nipple operable from outside the wellhead and casing, the nipple and its concentric mandrels being inserted into the wellhead and thus down through the wellhead array and into the casing or tubing by a single hydraulic cylinder and then the nipple expanded and sealed in the casing or tubing. The cylinder and its support rods may be removed when the nipple and mandrels are in place.

8 Claims, 9 Drawing Sheets

WELLHEAD ISOLATION TOOL

FIELD OF THE INVENTION

This invention relates to wellhead isolation tools and in particular to a tool with concentric mandrels and an expanding nipple, the insertion of the nipple being done by a single hydraulic insertion cylinder and the expansion of the nipple being done by a concentric hydraulic actuating cylinder or the insertion cylinder.

BACKGROUND OF THE INVENTION

In oilfield service work, a piece of equipment referred to in the trade as a "tree saver" or wellhead isolation tool is often used. This apparatus generally introduces a high pressure mandrel with a sealing nipple through the low pressure rated valves and fittings on a wellhead and the resilient sealing material on the nipple at the lower end of the mandrel seals the mandrel in the well tubing or casing. This allows high pressure fluids to be introduced into the well tubing or casing through the mandrel without their having any communication with these low pressure rated valves and fittings. The state of the art equipment which utilizes concentric mandrels and an expanding nipple is that described both in my Canadian Pat. No. 1,217,128 issued Jan. 27, 1987 and my U.S. Pat. No. 4,657,075, issued Apr. 14, 1987. A later configuration of the tool, having improvements over the original, is now described. It utilizes the principle of the concentric mandrels and the sealing nipple and expander.

SUMMARY OF THE INVENTION

According to a broad aspect, the invention relates to a novel method to insert and operate a concentric mandrel apparatus in a wellhead. The apparatus comprises means for mounting the apparatus on a wellhead; upper and lower plates, rigidly spaced with two or more removable stay rods; the lower plate being secured to the mounting means, the upper having concentrically mounted in it a hydraulic cylinder called the insertion cylinder, the piston rod end of which is free to act in a downward and upward way on an assembly including the gate valve, the concentric mandrels actuating cylinder, the mandrels and the nipple and expander. In the lower plate is a concentrically mounted packing gland through which the mandrels extend, such packing gland holding back well pressure and also having means to removably attach it to the double acting actuating cylinder into which the outer mandrel is threaded. The rod in this actuating cylinder is the inner mandrel, which has a piston attached to it. Introduction of fluid into the ports in this actuating cylinder moves the inner mandrel in respect to the outer mandrel. Threadingly attached to the outside of this actuating cylinder is a locking nut which can be moved to act on the upper connection of the inner mandrel which runs concentrically through it. To the upper connection of the inner mandrel is attached in a removable way, a gate valve which has on its upper end a method for attachment in a removable way to the piston rod of the insertion cylinder mounted in the upper plate.

BRIEF DESCRIPTION OF THE DRAWINGS

The invention is illustrated by way of example only in the accompanying drawings in which.

DESCRIPTION OF THE PREFERRED EMBODIMENT

Figure 1:
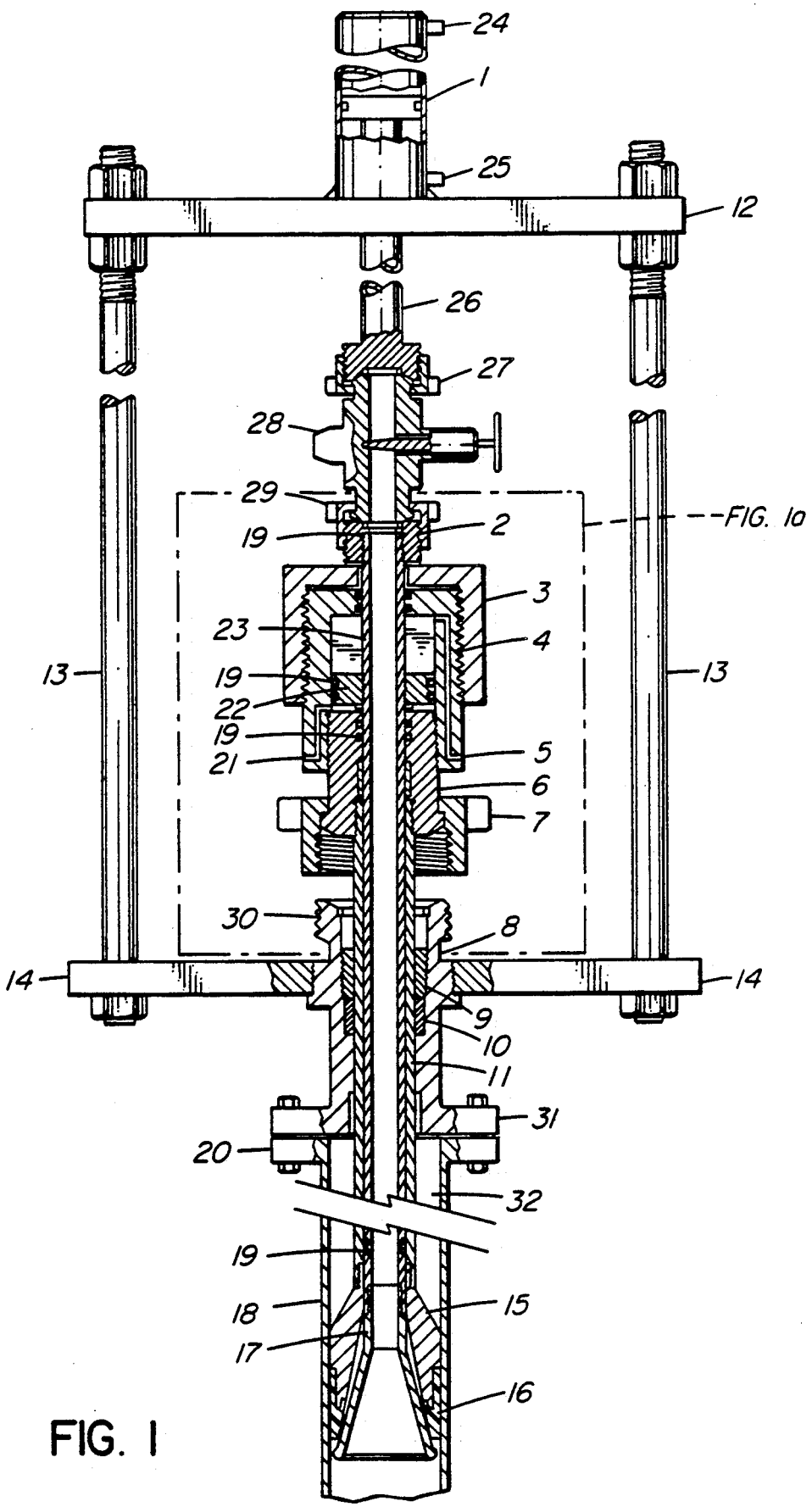
FIG. 1 is an elevation view, partly in section, of the complete wellhead isolation tool in a mid-operated position.
Figure 1A:
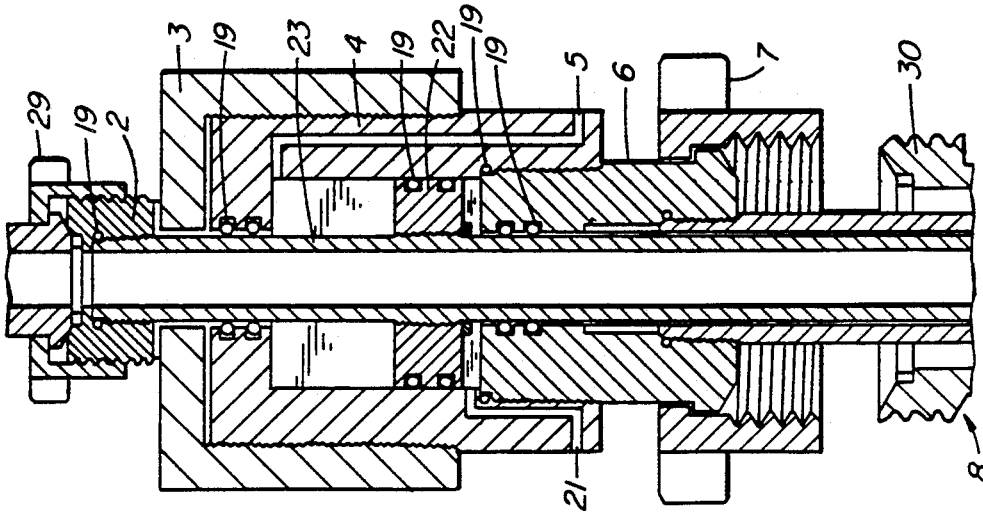
FIG. 1*a* is an enlarged view of the area shown in phantom line in FIG. 1.
Figure 7:
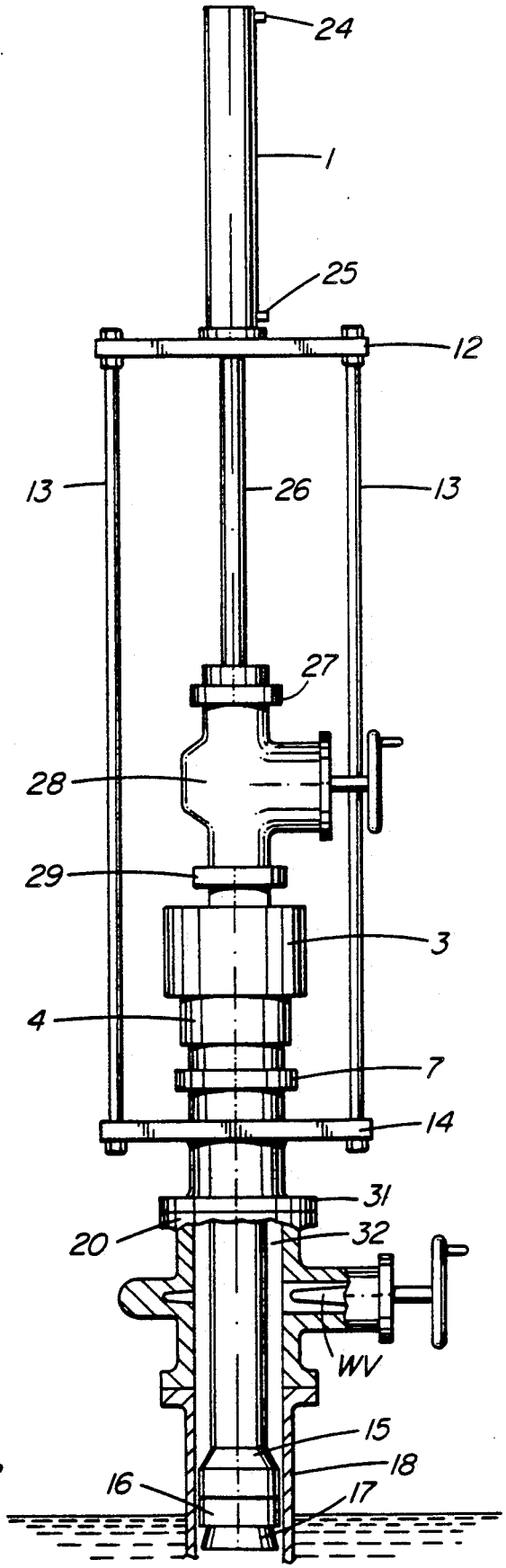
FIG. 7 is an elevation view, partially in section, of a simplified wellhead, master valve and casing with the wellhead isolation tool in the installed position prior to activating.

Referring to FIGS. 1 and 1*a*, the tool illustrated generally includes a hydraulic insertion cylinder 1, with ports 24 and 25, this insertion cylinder affixed concentrically in a removable way to an upper plate 12, the piston rod 26 of the insertion cylinder extending through the upper plate in a downward direction and terminating in the removable union 27. The type of hydraulic insertion cylinder is not confined to be a simple rod and piston cylinder as shown, but may be a telescoping cylinder or a double ended cylinder. A jackscrew is also proposed as an alternative method of moving the isolating apparatus into the wellhead. The upper plate is attached rigidly to the lower plate by two or more removable rods and nuts 13. Concentrically through and attached to the lower plate 14 is the lower body 8 with its packing 10 and packing gland 9. It also is adapted by flange 31 to fit the wellhead flange 20 also shown in FIG. 7. It is also fitted with a thread 30 to mate with the hammer union ring 7. It will be noted that the various unions shown could be of the clamp type or the bolted flange type and still serve the, same purpose. The hammer union ring is restrained by a shoulder on the actuating cylinder gland 6 which at its lower end is threaded internally for the outer mandrel 11 and at its top end is threaded into the actuating cylinder 4 which cylinder has threads on its outside for the locknut 3. This actuating cylinder also has fluid ports 21 and 5. The inner mandrel 23 passes through the actuating cylinder gland and appropriate seals 19 and has affixed to it a piston 22. The mandrel 23 extends through the actuating cylinder and the locknut 3 and terminates at its upper end in the union end 2, which union end shoulders against the locknut 3. To this union end is attached the gate valve 28 by way of a hammer ring 29. The upper end of the gate valve is attached to the insertion cylinder piston rod 26 by hammer ring union 27. At the lower end of the inner mandrel is the expander nipple 17. At the lower end of the outer mandrel is the sealing nipple 15 with its molded sealing element 16. The tubing or casing to which the nipple will seal is noted at 18. The cavity 32 is that space above the sealing nipple which is to be isolated from the well pressure. It will consist of wellhead valves and fittings.

The apparatus thus described as in Figures 1 and 1*a* is in a mid-operated position, meaning it has been installed on the wellhead and the nipple and expander have been moved through the wellhead and into the casing. We will use the word casing to mean both tubing and casing for the rest of this explanation. This movement has been done by introducing fluid into the insertion cylinder port at 24 and thus pushing down the piston rod and the associated apparatus. It will be noted that the gate valve 28 is in the closed position during all these operations as the pressure from the well will be in the inner mandrel.

Figure 2:
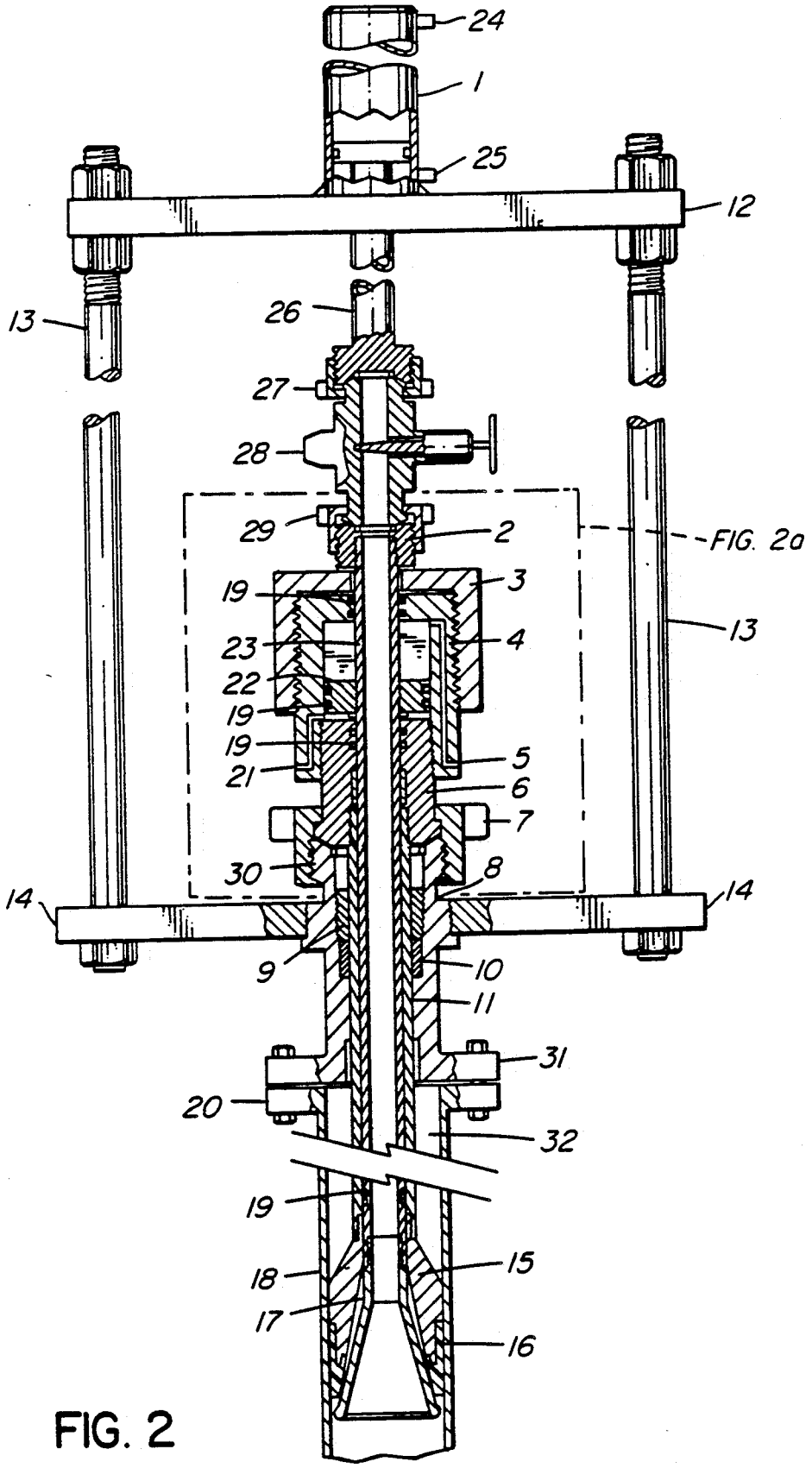
FIG. 2 is a view similar to FIG. 1, but in another operative position prior to taking off the insertion cylinder and stay rods.
Figure 3:
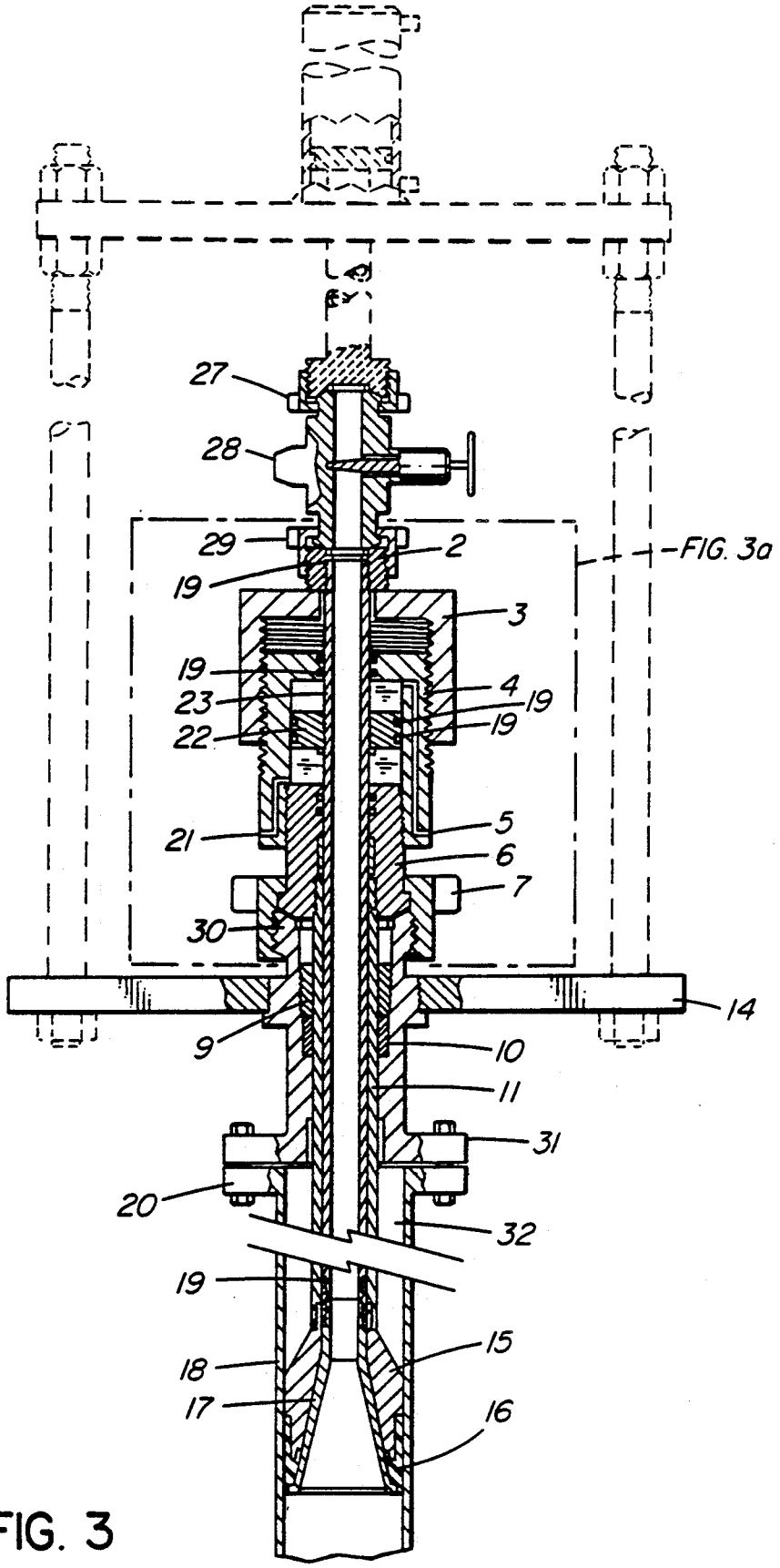
FIG. 3 is a view similar to FIG. 2, but in the actuated and sealed operative position with the insertion cylinder and stay rods removed. (These are shown in broken lines)
Figure 3A:
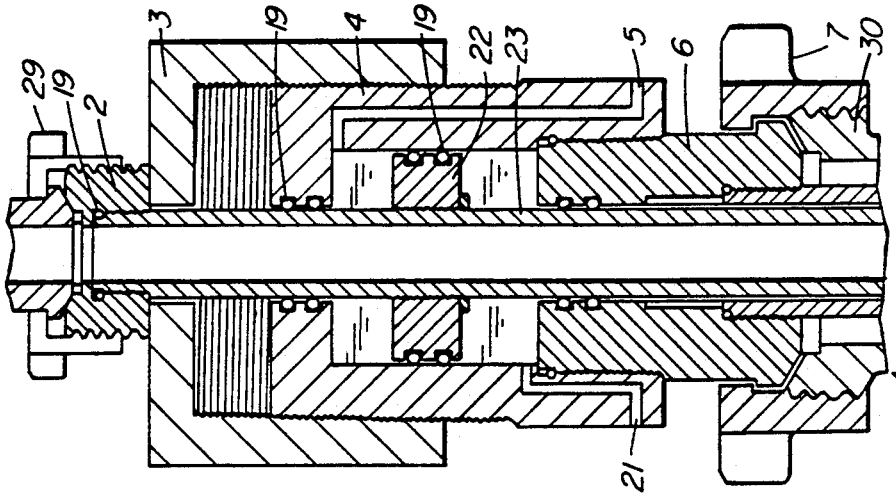
FIG. 3*a* is an enlarged view of the area shown in the phantom line square "3*a*" in FIG. 3.
Figure 2A:
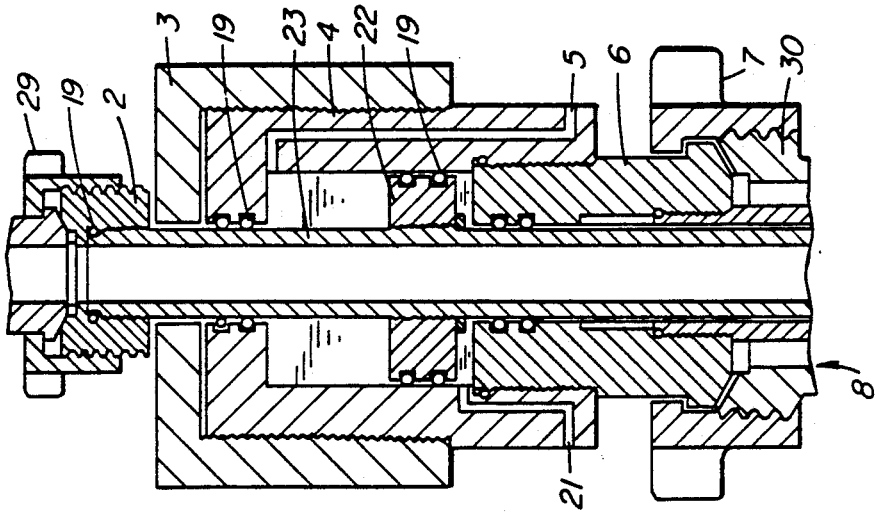
FIG. 2*a* is an enlarged view of the area shown in phantom line in FIG. 2.
Figure 3B:
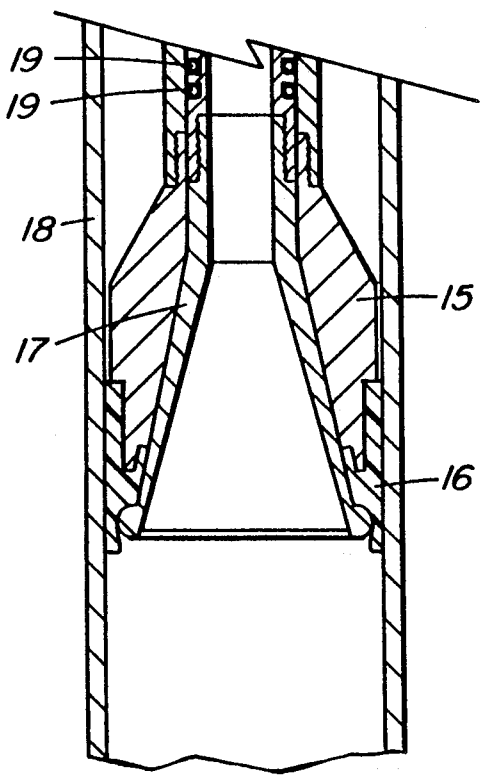
FIG. 3*b* is an enlarged view of the nipple and expander end of FIG. 3.
Figure 2B:
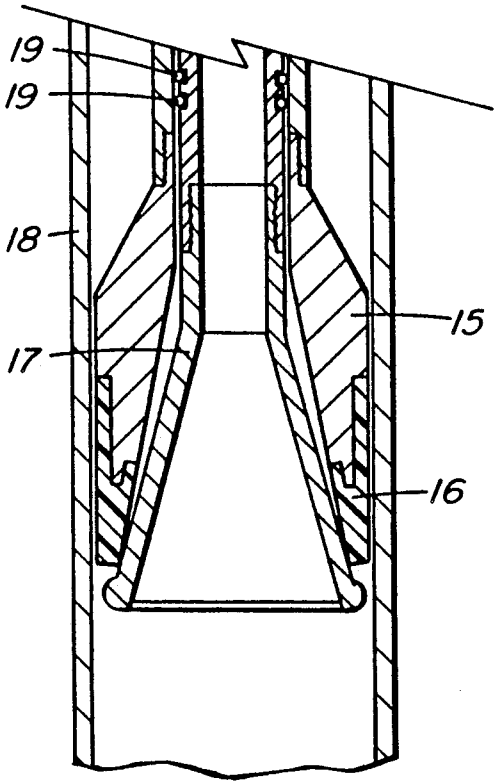
FIG. 2*b* is an enlarged view of the nipple and expander end of FIG. 2.
Figure 1B:
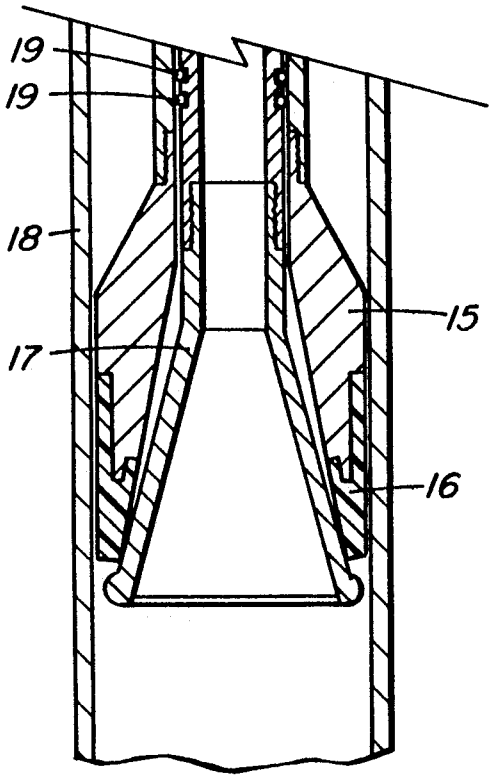
FIG. 1*b* is an enlarged view of the nipple and expander end of FIG. 1.

FIGS. 2 and 2*a* show the apparatus in position for setting the seal. The movable parts of the apparatus have been brought together, with the actuating cylinder gland 6 meeting with the lower body 8 and being attached to it rigidly by the hammer union ring 7 engaging the thread 30 on the lower body. The insertion cylinder 1 and stay rods 13 could be disassembled at this point, but for safety, they are usually left on. The port 24 in the insertion cylinder 1 is opened to allow this cylinder to float. Fluid from an outside source is now fed into port 21 in the actuating cylinder 4. FIGS. 3 and 3*a* show the reaction of the apparatus. The piston 22 and the attached inner mandrel 23 move in an upward direction and thus move the expander nipple 17 against the molded sealing element 16 and deform and compress it against the casing 18 as shown in FIG. 3*b*. This effectively seals off any pressure from inside the inner mandrel 23 and the well casing and the cavity 32. The locknut 3 is rotated in such a direction that it once again will shoulder against the union end 2 on the mandrel 23 (FIG. 3*a*), which had moved away from it, effectively locking the inner and outer mandrels 23, 11 in relative position, and thus mechanically locking the sealing nipple 15, molded sealing element 16 and expander nipple 17 in the sealed position (FIG. 3*b*). The ports at 5 and 21 in the actuating cylinder 4 may also be sealed to lock the mandrels hydraulically. The insertion cylinder and stay rods will now be disassembled and the external piping attached to the gate valve. Fluids under high pressure may now be pumped through the mandrel and into the well casing after opening the gate valve 28 on the mandrel.

When it is time to unseal and extract the mandrels and nipples from the well casing, the gate valve 28 is closed, the insertion cylinder 1 and stay rods 13 are again assembled, the locknut 3 is turned down from shouldering against the union 2 on the mandrel, fluid is pumped into port 5 of the actuating cylinder 4, thus moving the inner mandrel 23 downwardly in relation to the outer mandrel 11 and the expander nipple 15 moves away from the molded sealing element 16, thus releasing the seal from the casing 18. The hammer union 7 is undone and fluid is pumped into the insertion cylinder port 25 and the mandrel assembly of nipple 15, sealing element 16 and expander nipple 17 is withdrawn from the wellhead up into the cavity 32 where they engage the bottom end of the lower body 8. The wellhead valves (WV, FIG. 7) will now be closed to contain the well pressure, and the isolation tool will be removed from the wellhead by disconnecting the lower body flange 31 from the wellhead flange 20. During some of these operations, pressure from the well will cause different actions on the tool, and may have to be equalized across the molded sealing rubber and may have to be countered by restricting flow from the insertion cylinder port 24. These are common practices and are not claimed as part of this application.

Figure 5:
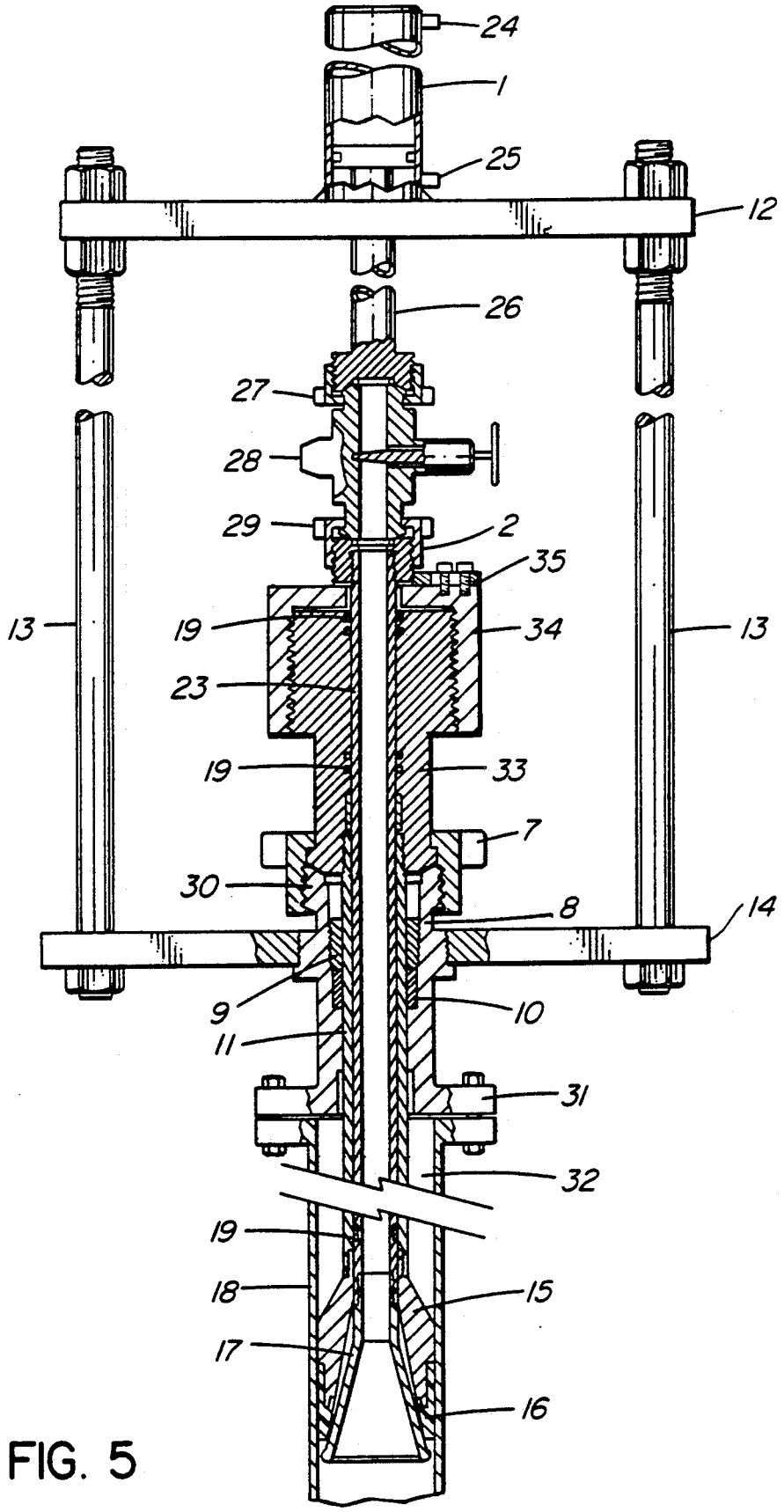
FIG. 5 is a view similar to FIG. 4, but in another operative position.
Figure 6:
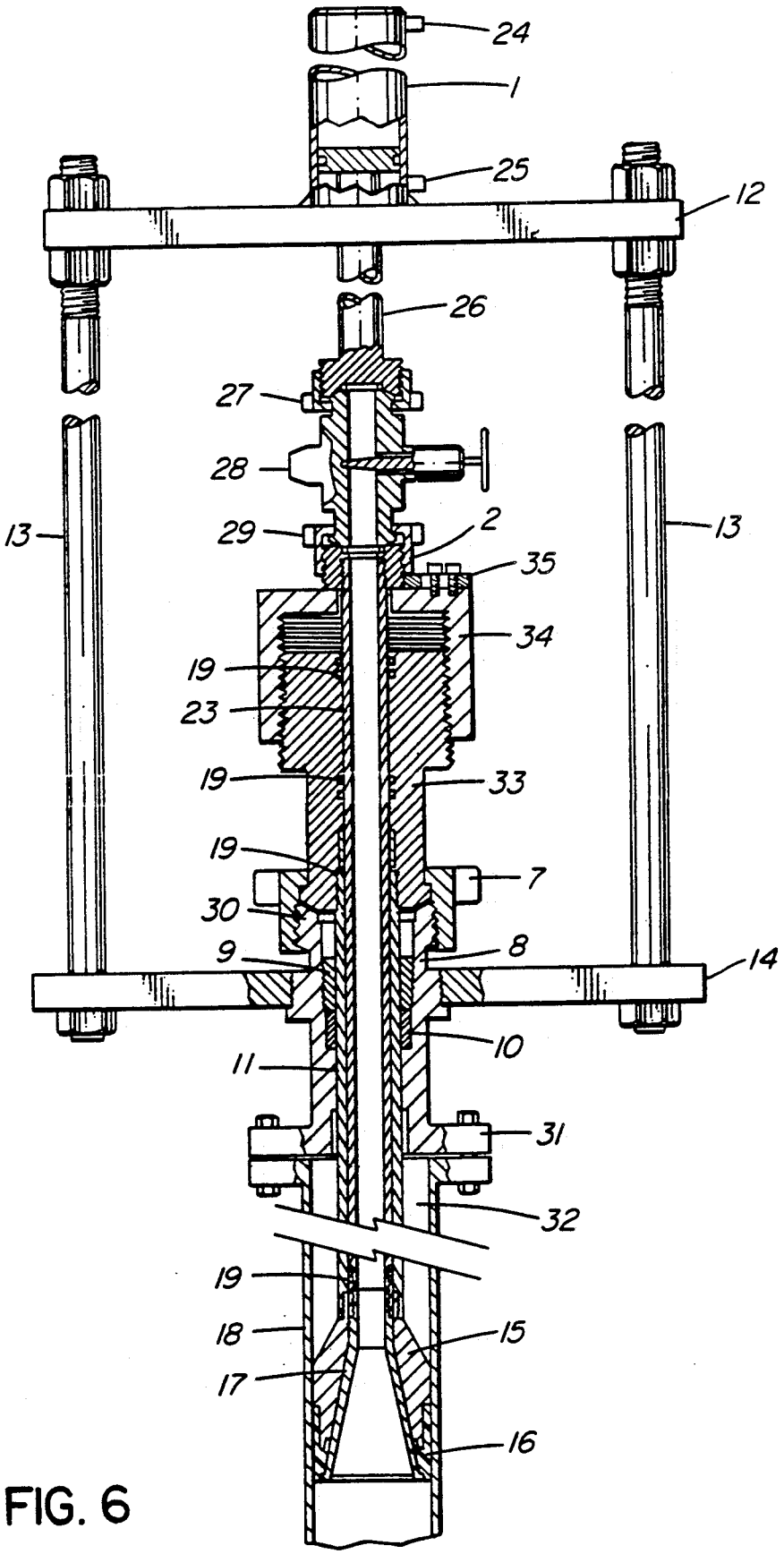
FIG. 6 is a view similar to FIG. 5, but in the actuated and sealed operative position, prior to taking the insertion cylinder and stay rods off.

It will be obvious to anyone skilled in the art of this type of equipment that the described invention could be simplified by leaving out the actuating cylinder and piston, and utilizing the possible actions of the insertion cylinder to accomplish the sealing at the nipples. This embodiment of the invention and its operation is shown in FIGS. 4, 5 and FIG. 6.

DESCRIPTION OF THE SECOND EMBODIMENT

Figure 4:
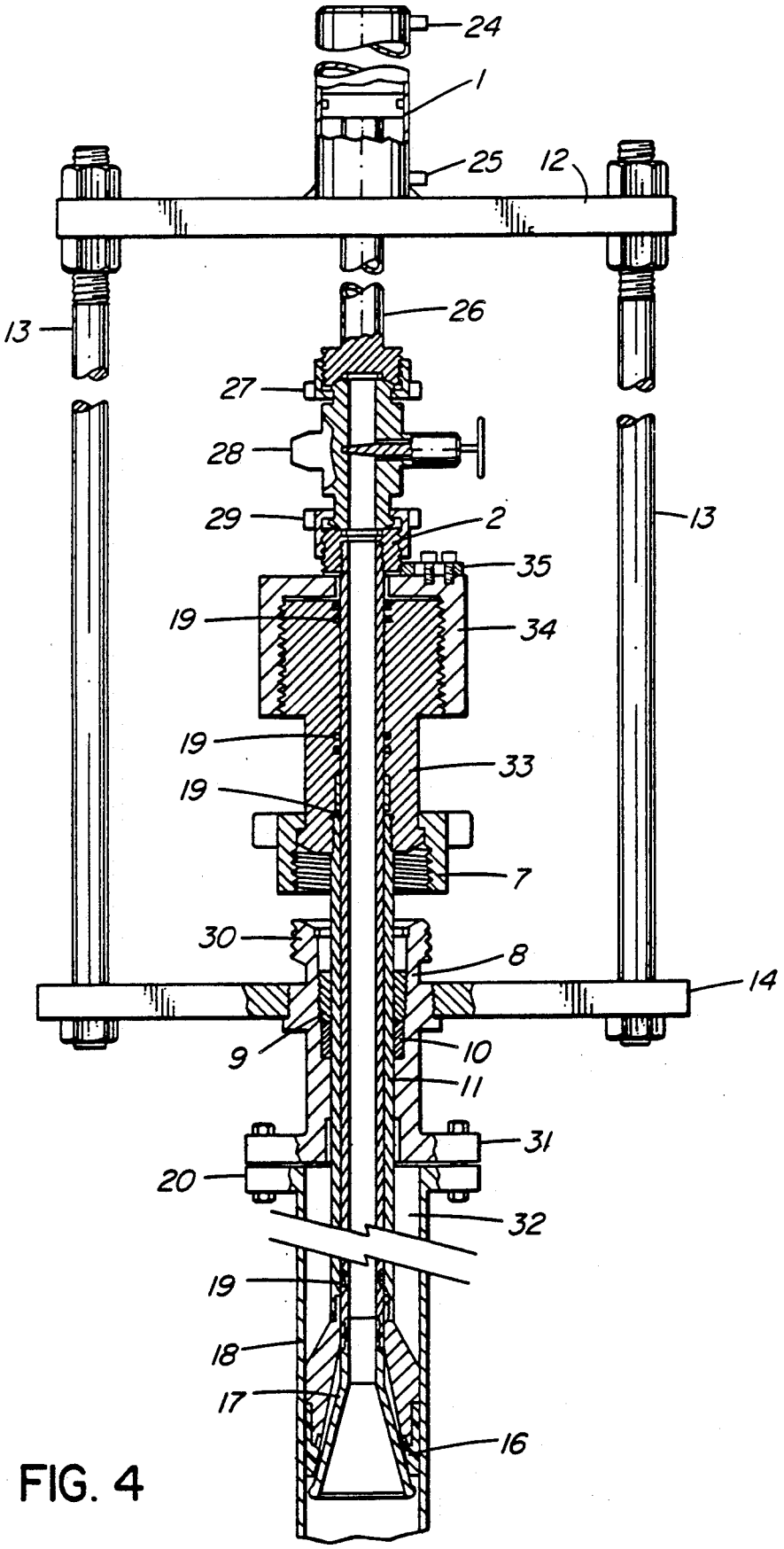
FIG. 4 is an elevation view, partly in section, of the complete wellhead isolation tool as per the second embodiment, in a mid operated position.

Referring to FIGS. 4 and 4*b* it will be seen that the isolation tool is identical to the previous embodiment but with the actuating cylinder 4 and the piston 22 on the mandrel 23 removed and the actuating cylinder gland renamed the inner mandrel gland 33. In the lower end of this gland is secured the outer mandrel 11 and held threadingly on the outside of the gland is the locknut 34. A feature of this locknut is the slidingly attached locknut dog 35, shown engaged, which by its action on the inner mandrel union 2 can lock the inner mandrel 23 to the locknut 34 or when disengaged, allow the inner mandrel 23 to move axially out of the locknut. One dog is shown, but several may be used, or other methods such as pins or the like designed that will allow the inner mandrel union 2 to be locked to the locknut. In operation, the complete tool is secured on the wellhead with the gate valve 28 in the closed position and the locknut dog in the engaged position. The appropriate wellhead valves are opened and fluid from an outside source pumped into the insertion cylinder at 24. The fluid action moves the piston rod 26 and the gate valve 28 with the rest of the assembly through the wellhead cavity 32 and into the casing 18. When the inner mandrel gland 33 meets the lower body 8, the hammer union 7 is rotated onto the threads 30 and these parts are held rigidly together. The tool is now in the position shown on FIG. 5. The locknut dog 35 is now disengaged. FIG. 6 shows the action of the insertion cylinder 1 on the inner mandrel 23 when fluid is put into port 25 of the insertion cylinder. The mandrel is pulled up, moving the expander nipple 17 against the molded sealing element 16 and compressing it against the casing 18. The locknut 34 is now rotated in a direction to move it up so it will shoulder against the mandrel union 2 and lock the two mandrels 23, 11 in relative position, thus locking the sealing nipples in position. It will be appreciated that this embodiment of the tool does not have the additional hydraulic lock shown on the previous embodiment. The insertion cylinder 1 and the stay rods 13 are now disassembled from the lower plate and the external piping attached to the gate valve 28, and this valve opened to allow the high pressure fluids to be pumped down through the mandrel into the casing.

When the treatment of the well is finished, the gate valve 28 is closed, and the external piping detached. The insertion cylinder 1 is once again assembled in place with its stay rods 13 and the piston rod 26 attached to the gate valve. The locknut 34 is rotated so it moves down and thus away from the mandrel union 2. When it is in its bottom position, fluid is pumped into the insertion cylinder through port 24, and the inner mandrel 23 is forced down, moving the expander nipple 17 out of the molded rubber 16, thus relieving the sealing pressure between the sealing nipple and the casing 18. The locknut dog 35 is now engaged. The hammer union 7 is loosened off and fluid is fed into the insertion cylinder port 25, thus pulling up on the gate valve 28 and assembly attached to it. When the nipple is clear of the wellhead valve and into the cavity 32 at the bottom of the lower body 8, that valve is closed and the isolation tool is taken off of the wellhead.

Those skilled in the art will appreciate that various features, characteristics and advantages of the present invention have been set forth herein or are readily realizable from the detailed description of the preferred embodiments. However, the disclosure is illustrative and various changes may be made while utilizing the principles of the present invention and falling within the scope of the invention as expressed in the appended claims.

what is claimed is:

1. A wellhead isolation tool having a mandrel assembly for insertion into and sealing off a wellhead casing, said tool comprising:

(a) means for detachably mounting said tool on said wellhead casing;

(b) rigidly spaced, parallel upper and lower plate members, said lower plate member being secured to said mounting means;

(c) said mandrel assembly including concentrically arranged inner and outer mandrels having their upper, driven ends located intermediate said plate members and their lower, operative ends extending below said detachable mounting means of said tool for insertion into said casing;

(d) said outer mandrel having a sealing nipple including a deformable element on the lower end thereof and said inner mandrel having a nipple expander on the lower end thereof, said nipple expander being concentrically located with respect to and inwardly of said sealing nipple and deformable element on the end of said outer mandrel;

(e) means mounted on said upper plate member and connected to the driven end of said mandrel assembly for raising or lowering the operative ends thereof in said wellhead casing;

(f) an actuating cylinder concentrically mounted about the upper, driven ends of said mandrels, means secured to said inner mandrel adjacent the upper end thereof and operating in said actuating cylinder for effecting movement of said inner mandrel with respect to said outer mandrel and when raising said inner mandrel causing said nipple expander on its lower end to effect outward, radial pressure against said deformable seal and the casing wall; and (g) means on said actuating cylinder for locking the inner mandrel in position relative to the outer mandrel.

2. Apparatus according to claim 1, wherein said means for detachably mounting said tool comprises a lower body portion of said assembly and being secured to said lower plate member; said body having a threaded upper end for connection to the lower end of said actuating cylinder; packing means in said body for pressure sealing said outer mandrel operating therethrough; and flange means on the lower end of said body for detachably connecting said isolation tool onto said wellhead.

3. Apparatus according to claim 1, wherein said means mounted on said upper plate member comprises a fluid operated insertion cylinder the piston rod end of which is interconnected to the upper end of said mandrel assembly, and a gate valve intermediate of and connect to said piston rod end and said mandrel assembly.

4. Apparatus according to claim 1, wherein said actuating cylinder includes a housing having:

(a) a threaded, exterior upper end;

(b) a circumferential locknut threadably engaging said exterior and having a planar top end;

(c) a gland member threaded into the lower end of said housing; the upper end of said outer mandrel being secured in said gland, and means for releasably securing said gland member to said mounting means; and piston means secured to said inner mandrel adjacent the upper end thereof and being located in said actuating cylinder whereby fluid pressure applied to said piston effects telescopic movement of said inner mandrel with respect to said outer mandrel.

5. A concentric mandrel apparatus for use as a wellhead isolation tool, said apparatus comprising:

(a) means for mounting said apparatus on a wellhead;

(b) rigidly spaced, parallel, upper and lower plate members, said lower plate member being secured to said mounting means;

(c) a mandrel assembly comprising concentrically arranged inner and out mandrels, and a gland member circumferentially located about said mandrels;

(d) said outer mandrel of said assembly being secured at its upper end to said gland member and extending down through said mounting means and having nipple means with a resilient sealing member on its lower end;

(e) said inner mandrel being interconnected at its upper end to said upper plate member and extending down through said gland member and said mounting means and having a seal expander on its lower end;

(f) means in said mandrel assembly for locking said inner mandrel with respect to said outer mandrel;

(g) an actuator connected to said mandrel assembly for (i) moving said assembly downwardly into said well casing and (ii) for moving said inner mandrel with respect to said outer mandrel whereby said expander engages and deforms said sealing member against said casing.

6. Apparatus according to claim 5, wherein said means for mounting said apparatus comprises a lower body portion of said assembly and being secured to said lower plate member; said body having a threaded upper end for connection to the lower end of said gland member; packing means in said body for pressure sealing said outer mandrel operating therethrough; and flange means on the lower end of said body for detachably connecting said isolation tool onto said wellhead.

7. Apparatus according to claim 5, wherein said actuator comprises a fluid-operated cylinder having its body portion secured to said upper plate member, the piston rod thereof being interconnected to said piston rod end and said mandrel assembly.

8. Apparatus according to claim 5, wherein said gland member comprises a first, inner portion having the upper end of the inner mandrel secured in the lower end thereof, and a second, outer portion threadably mounted on the exterior of said inner portion.

* * * * *